United States Patent [19]

Comfort

[11] 3,954,531

[45] May 4, 1976

[54] COMPOSITE DOUBLE BASE PROPELLANT COMPOSITION CONTAINING FERRIC FLUORIDE

[75] Inventor: Theodore F. Comfort, Cumberland, Md.

[73] Assignee: The United States of America as represented by the Secretary of the Navy, Washington, D.C.

[22] Filed: June 14, 1973

[21] Appl. No.: 370,585

[52] U.S. Cl. ..... 149/38; 149/42; 149/76; 149/92; 149/97; 343/18 B

[51] Int. Cl.[2] ..... C06B 33/08

[58] Field of Search ..... 149/38, 42, 92, 76, 149/95, 97, 98; 343/18 B

[56] References Cited

UNITED STATES PATENTS 3,811,966 5/1974 Hill et al. ..... 149/97 X

*Primary Examiner*—Stephen J. Lechert, Jr.
*Attorney, Agent, or Firm*—R. S. Sciascia; J. A. Cooke; T. E. McDonnell

[57] ABSTRACT

Composite-modified double base propellants containing aluminum as a metal fuel having ferric fluoride added as a combustion catalyst, a thermal stabilizer and an aid in reducing exhaust plume interference with a radar guidance system.

10 Claims, No Drawings

COMPOSITE DOUBLE BASE PROPELLANT COMPOSITION CONTAINING FERRIC FLUORIDE

BACKGROUND OF THE INVENTION

This invention relates generally to improved composite modified double base propellants suitable for use in end-burning missile motors which may be stored for long periods of time.

Solid propellants which are classified as composite modified double base (CMDB) propellants contain at least an oxidizer, fuel, binder, and plasticizer. Additional ingredients are added to modify the propellant ballistics or to give the propellant additional capabilities, e.g. long storage.

Impulse is the measure of the total energy of a missile motor. The delivered specific impulse is the impulse per pound of propellant and it is the most important parameter in propellant development. One common method of increasing the delivered specific impulse is to increase the propellants specific impulse efficiency which is defined as the ratio of the delivered specific impulse over the theoretical specific impulse.

It has been known that certain fluorine compounds have been helpful in increasing the delivered specific impulse of composite modified double base (CMDB) propellant. Unfortunately, the compounds used had a number of disadvantages. Fluorine-carbon compounds produced a stable and insensitive CMDB propellants, but they did not greatly increase the delivered specific impulse of the CMDB propellant. Fluorine-nitrogen and fluorine-oxygen compounds significantly increase the delivered specific impulse of the CMDB propellant but they also increased the instability and sensitivity of the solid propellant, thereby restricting the storage life and creating handling problems. Thus, no known fluorine containing compound has heretofore been discovered which would increase the specific impulse greatly without adversely affecting the composition in some other manner.

Another important parameter in propellant development is density. A greater density allows the design of smaller missiles or greater payloads or ranges for missiles. Unfortunately, it is also a difficult parameter to obtain because compounds which increase the density of the CMDB propellant also increase instability and sensitivity of the propellant.

Since most modern missile weapon systems require radar communication and tracking between a control station and an in-flight rocket for guidance control, any interference with the radar signal would hamper the guidance of the missile. Often the rocket exhaust plume is a substantial cause of this.

A significant contributor to the interference caused by the rocket exhaust plume is the chemical and thermal makeup of the exhaust plume. For this reason many propellant formulations are of limited value although they have a sufficiently high specific impulse. A good example of this type of propellant formulation would be those CMDB propellant using a large amount of aluminum for the metal fuel. Certain percentages of aluminum cannot be used although the resulting CMDB propellant would give a high specific impulse. Other percentages of aluminum can be used, but they present serious design problems.

SUMMARY OF THE INVENTION

Accordingly, it is an object of this invention to increase the payload capability of solid fuel missiles.

Another object of this invention is to increase the theoretical specific impulse.

Yet another object of this invention is to increase the delivered specific impulse.

Yet another object of this invention is to improve the specific impulse efficiency.

A still further object of this invention is greater flexibility in formulating solid propellants.

Another object of this invention is to increase the amount of metal fuel which can be used with standard CMDB propellant.

Still another object of this invention is to increase flexibility in the designing of missile motors.

A further object of this invention is to decrease radar attenuation caused by the missile exhaust.

A still further object of this invention is to decrease exhaust plume interference with the missile guidance radar signal.

Yet another object of this invention is to increase the density of standard composite modified double base propellants.

An additional object of this invention is to decrease the cost of manufacture of composite modifier double base propellants.

Another object of this invention is to increase the storage stability of CMDB propellants.

Yet another object of this invention is to increase the thermal stability of CMDB propellants.

A still further object of this invention is to decrease the ease of initiation sensitivity.

These and other objects of this invention are attained by using $FeF_3$ as a catalyst in CMDB propellants which utilize aluminum as the metal fuel.

DESCRIPTION OF THE PREFERRED EMBODIMENT

The ferric fluoride used as an additive to the conventional CMDB propellants which contain aluminum causes the aluminum to burn more completely and thereby increasing the specific impulse efficiency.

The exhaust from the combustion of a CMDB propellant with ferric fluoride contains fluorine. It has been discovered that the presence of fluorine in the exhaust plume attenuates the radar interference. Thus for a given aluminum content, the radar interference is decreased thereby allowing more freedom in the design of the missile and making feasible higher concentrations of aluminum in CMDB propellants.

Larger amounts of aluminum increases the theoretical specific impulse. Thus the delivered specific impulse can be increased by the use of ferric fluoride because of a greater combustion efficiency and a possibility of a greater theoretical specific impulse.

The addition of ferric fluoride decreases the amount of nitroglycerin or fluorine-nitrogen compounds needed in the propellant. Since the density of ferric fluoride is much greater than nitroglycerin, the density of CMDB is correspondingly greater. The thermal stability is also increased by the use of ferric fluoride for a similar reason, i.e., ferric fluoride is more stable than nitroglycerin or fluorine-nitrogen compounds.

It should be noted that within the meaning of this invention the term, composite-modified double base propellant (CMDB) shall cover propellants which contain an oxidizer, fuel, binder, and plasticizer. Naturally, as will be recognized by those skilled in the art those propellants may also contain various additives.

The practice of this invention does not limit the choice of material which can be used to formulate the CMDB propellant. Examples and weight percentage ranges of the materials which can be used in the practice of this invention are as follows:

The plasticizers which constitute about 15–30 percent of the compositions can be any of the art recognized plasticizers such as, for example nitroglycerin or triacetin or mixture thereof. Nitroglycerin would be the most preferred.

The binders may constitute about 7–15 percent of the CMDB propellant and may be any of the art recognized binders such as, for example nitrocellulose or plastisol nitrocellulose.

Oxidizers constitute about 25–50 percent of the composition and can be any of the art recognized oxidizers such as, for example ammonium perchlorate, sodium perchlorate, or cyclotetramethylene tetranitramine (HMX) and mixtures thereof. An excellent mixture would be ammonium perchlorate constituting 9–25 percent of the propellant and HMX constituting 9–30 percent of the propellant.

The metal fuel is aluminum or a mixture of aluminum with other metals and constitute 10–25 percent of the CMDB propellant. It should be noted that the present invention deals only with CMDB propellants which contain some aluminum.

Additives like resorcinol or ethyl centralite may be included.

The amount of ferric fluoride may vary from about 1–3 percent, with about 1.5 percent being the most preferred quantity.

For the purpose of illustration the following two formulations which were prepared are set forth:

| | Formulation | (weight percent) |
|---|---|---|
| Propellant composition | 1 | 2 |
| Adiponitrile | 3.4 | 3.3 |
| Aluminum | 12.0 | 22.0 |
| Ammonium Perchlorate | 11.2 | 19.6 |
| Ferric Fluoride | 1.5 | 1.5 |
| HMX | 27.1 | 10.6 |
| Nitrocellulose | 13.0 | 12.4 |
| 2-Nitrodiphenylamine | 1.0 | 1.0 |
| Nitroglycerin | 29.8 | 28.6 |

-continued

| | Formulation | (weight percent) |
|---|---|---|
| Propellant composition | 1 | 2 |
| Resorcinol | 1.0 | 1.0 |

There is no limitation on the method of preparation of any propellant within the scope of this invention. Any standard solvent or solventless method may be used and followed by a normal cure cycle.

Obviously, numerous modifications and variations of the present invention are possible in light of the above teachings It is therefore understood that within the scope of the appended claims the invention may be practice otherwise than as specifically described herein.

What is claimed as new and desired to be secured by Letters Patent of the United States is:

1. In a composite-modified double base propellant containing aluminum, the improvement comprising about 1–3 weight percent of ferric fluoride as a combustion catalyst in combination with said propellant.

2. The improved composite-modified double base propellant of claim one wherein the weight percentage of ferric fluoride is about 1.5.

3. A composite-modified double base propellant comprising 10–25 weight percent of aluminum, 25–50 weight percent of ammonium perchlorate, 7–15 weight percent of nitrocellulose, 1–3 weight percent of ferric fluorine, and 15–30 weight percent of nitroglycerin.

4. The propellant of claim 3 wherein the ferric fluoride constitute 1.5 weight percent.

5. The propellant of claim 3 wherein ammonium perchlorate constitute 9–25 weight percent and 9–30 weight percent of cyclotetramethylene tetranitramine is added.

6. The propellant of claim 5 wherein the ferric fluoride constitute 1.5 weight percent.

7. A method of increasing the specific impulse effeciency of composite-modified double base propellants containing aluminum, comprising adding about 1–3 weight percent of ferric fluoride to the propellant composition.

8. The method of claim 7 wherein about one and a half weight percent of ferric fluoride is added.

9. A method of decreasing exhaust plume interference with a radar guidance system of a missile being propelled by a composite modified double base propellant having aluminum as a metal fuel comprising adding about 1–3 weight percent of ferric fluoride to the propellant.

10. The method of claim 9 wherein about one and a half weight percent of ferric fluoride is added.

* * * * *